United States Patent [19]

Freedman

[11] 4,104,897

[45] Aug. 8, 1978

[54] TUMBLER LOCK

[76] Inventor: Gerald A. Freedman, c/o Fish & Richardson, Ste. 2100, 28 State St., Boston, Mass. 02109

[21] Appl. No.: 697,936

[22] Filed: Jun. 21, 1976

Related U.S. Application Data

[63] Continuation-in-part of Ser. No. 590,334, Jun. 25, 1975, abandoned.

[51] Int. Cl.[2] ..... E05B 29/06

[52] U.S. Cl. ..... 70/363; 70/376

[58] Field of Search ..... 70/351, 358, 363, 376, 70/362, 350, 377

[56] References Cited

U.S. PATENT DOCUMENTS

| | | | |
|---|---|---|---|
| 450,745 | 4/1891 | Lincoln | 70/363 |
| 2,044,534 | 6/1936 | Lejbowicz | 70/363 |
| 2,142,610 | 1/1939 | Kittler | 70/363 |
| 2,588,230 | 3/1952 | George | 70/363 |
| 3,916,657 | 11/1975 | Steinbach | 70/363 |

*Primary Examiner*—Kenneth J. Dorner

[57] ABSTRACT

Within a common tumbler chamber an adjacent plurality of dragged lock tumblers travel axially to an alignment arrangement, are returned to a constant misalignment arrangement by a common tumbler returning means, and are adaptable to couple a centrally rotatable lock plug to and from a lock cylinder. In certain embodiments, ribbed split-pin lock tumblers couple a splined plug to and from a splined cylinder, while in other embodiments non-ribbed split-pin lock tumblers couple a plug to a cylinder. Lock tumblers are also returned to constant misalignment by a plurality of biased members each of which is offset in spaced recesses in the surface of a common tumbler chamber.

20 Claims, 11 Drawing Figures

FIG 1
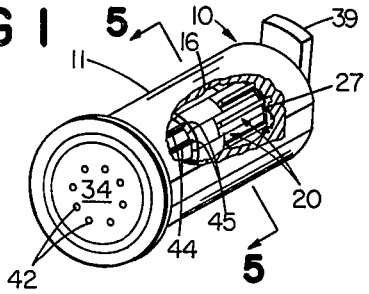
FIG 2
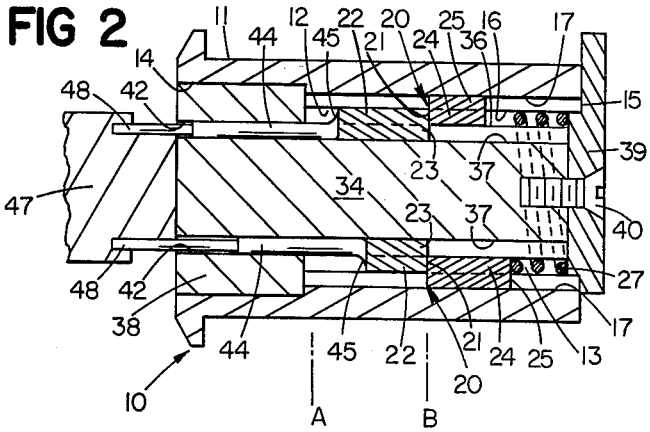
FIG 4
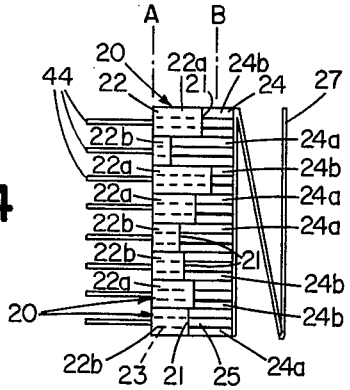
FIG 3
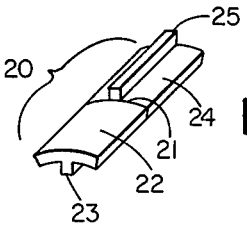
FIG 5
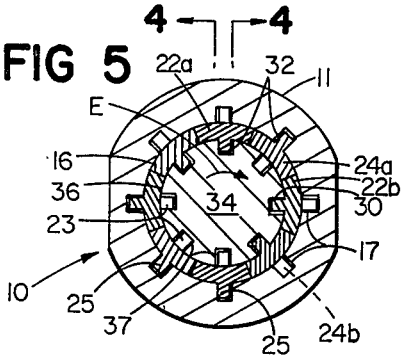
FIG 9
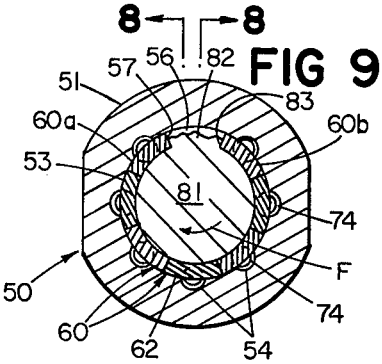
FIG 10
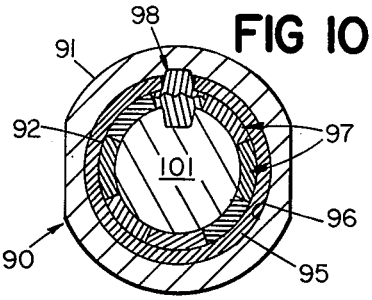
FIG 7
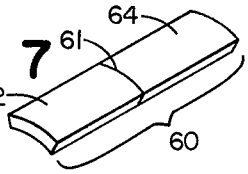
FIG 11
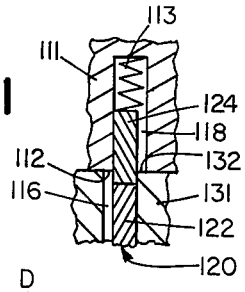
FIG 8
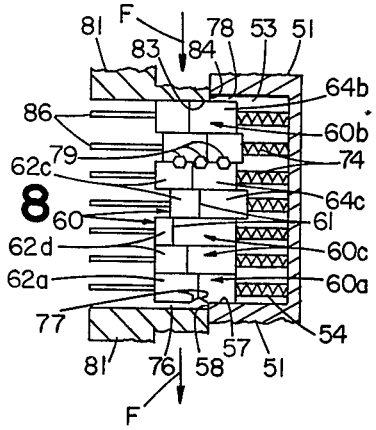
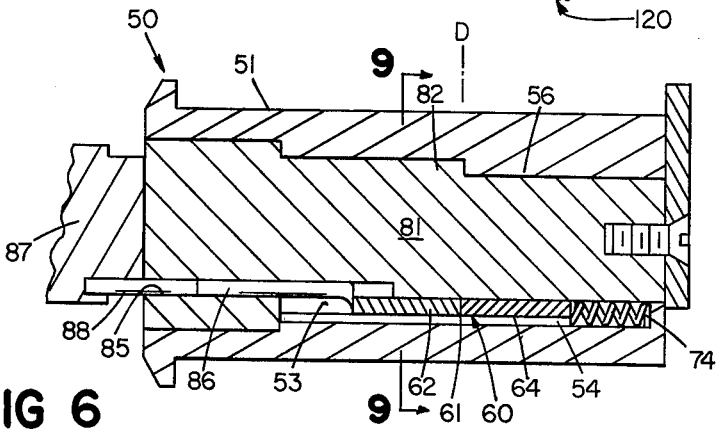
FIG 6

TUMBLER LOCK

CROSS-REFERENCE TO RELATED APPLICATION

This application is a continuation in part of my U.S. Pat. application Ser. No. 590,334, "Matrix Pin Tumbler Locks," filed June 25, 1975, and now abandoned, the benefit of which filing date is herein claimed.

BACKGROUND OF THE INVENTION

This invention relates to key controlled tumbler locks.

Various attempts to make a lock pickproof by complicating its tumbler mechanism have been made. Basically, lock manipulation is still practical because the way in which the tumbler couple and travel clearances are presented under torque remains unimproved. It would be desirable to provide an arrangement of lock tumblers that form couple and travel clearances in a way that cannot be so easily detected. It would also be worthwhile to prevent reverse picking, which is made possible when one tumbler can be returned from beyond alignment back to alignment independently of other tumblers, as by separate springs.

Winn U.S. Pat. No. 151,461 attempts to provide a pickproof lock, and shows pronged notched pin tumblers returned to misalignment by a single spring. There is no teaching of the necessity of dragging the travel of tumblers to alignment, and the complex arrangement of the curved prongs of the tumblers appears to render the lock inoperative. Also, it is basic to the design thereof that the bits of the key be brought out of contact with all but one of the tumblers during operation of the lock by the key.

Buchanan-Wollaston U.S. Pat. No. 2,302,414 shows an axial lock in which split-pin tumblers are adjacent together in the same chamber. A separate means independent of the key is necessary to move the plug relative to the cylinder after the key has aligned the tumblers. Such a means can be used to torque the lock to assist in picking.

Heyer U.S. Pat. No. 1,498,035 and Wise U.S. Pat. No. 1,696,829 each show differing ways of arraying split-pin tumblers in the same chamber. Neither array develops couple and travel clearances in a manner that is difficult to detect.

Clark U.S. Pat. No. 1,401,044 shows an axial lock in which block-pin tumblers are together adjacent in the same chamber. Basic design of block-pin tumblers requires a chamber of non-constant axial cross section.

Crepinsek U.S. Pat. No. 3,393,542 shows split-pin tumblers together adjacent within communicating chambers, each tumbler being driven by a spring that may be regarded as being located offset from a common tumbler chamber within a recess that intersects the chamber. These spring recesses intersect each other, and no means are shown for preventing entangling of the adjacent springs other than blind holes in the cylinder pins.

Scherbing U.S. Pat. No. 3,903,720 is a typical contemporary prior art axial lock construction that proposes to prevent easy manipulation of split-in tumblers by having the lock key couple to the plug via the key bits and tumblers.

SUMMARY OF THE INVENTION

This invention provides in an easily and inexpensively produced lock, a high security tumbler mechanism that renders reverse picking thereof virtually impossible and forward picking thereof statistically improbable. It is adaptable to perform in a wide range of general and special applications and can be constructed to be difficult to open by force, difficult to disable by vandalism, and not adversely affected by environmental conditions.

In general the invention features in one aspect a lock comprising a cylinder, a tumbler chamber within the cylinder, a keyway intersecting the chamber, a plurality of lock tumblers located together within the chamber, the tumblers traveling therein from a constant misalignment through variable misalignments to alignment, wherein whenever the tumblers are misaligned the lock cannot be operated and while the tumblers are aligned the said lock can be operated, a key having a plurality of bits that can enter the keyway to contact the tumblers and cause the same to variably travel toward alignment, means for dragging tumbler travel sufficient to prevent tumblers from traveling beyond alignment, and means for collectively returning the tumblers from alignment and all variable misalignments back to constant misalignment whenever the key is removed from the keyway, wherein whenever the key causes the tumblers to travel toward alignment, a subset of the dragged tumblers travels to alignment contacted with the means for returning and another subset of the dragged tumblers travels to alignment spaced from the means for returning.

The invention features in a second aspect a lock comprising a cylinder having a spline, a plug having a spline and retained movable with the cylinder, the plug and cylinder together defining a tumbler chamber, and a plurality of split-pin lock tumblers located together adjacent within the chamber, the tumblers having a plurality of ribs, at least one of which engages the cylinder spline and at least another of which engages the plug spline, wherein the tumblers couple the plug to the cylinder through the ribs whenever misaligned, and while the tumblers are aligned the plug is uncoupled from the cylinder.

The invention features in a third aspect a lock comprising a cylinder, a plug, a keyway, a plurality of split-pin tumblers that are located together adjacent within the same said chamber, wherein whenever the tumblers are misaligned and said plug is torqued relative to the cylinder the tumblers directly engage each other to prevent movement of the plug relative to the cylinder, and a key having a plurality of bits that can cause the tumblers to variably travel to alignment at which the key can cause relative movement between the plug and the cylinder and thereby operate the lock.

The invention features in a fourth aspect a lock comprising a cylinder, a plug having an axis about which the plug is retained rotatable with the cylinder, the cylinder and the plug together defining a tumbler chamber of constant axial cross section, a keyway that intersects the chamber, the keyway having an axis parallel with the plug axis, and a plurality of split-pin lock tumblers that are located adjacent within the chamber and that travel therein in a direction parallel with the axis of the plug from a constant misalignment through a plurality of variable misalignments to alignment, wherein the tumblers couple the plug to the cylinder whenever misaligned and wherein the plug is uncoupled from the cylinder while the tumblers are aligned.

The invention features in a fifth aspect a lock comprising a cylinder, a tumbler chamber within the cylinder having a plurality of spaced apart parallel recesses, a keyway intersecting the chamber, a plurality of lock tumblers that are located together adjacent within the chamber, the tumblers traveling therein parallel to the recesses from a constant misalignment through variable misalignments to alignment, and means for returning the tumblers from alignment and variable misalignments back to constant misalignment comprising a plurality of biased members each located partially within the chamber and partially within one of the recesses.

Preferred embodiments feature a key remaining in contact with the tumblers throughout lock operation; a single spring as the returning means; a cylinder and a plug each having a plurality of splines; tumblers having a shear wall taper; tumblers having a shear wall interlock; a keyway having a plurality of bores and a plurality of lead pins each of which slides axially within one of the bores; circumferentially adjacent split-pin tumblers; and tumblers traveling axially with respect to the keyway.

Other advantages and features of the invention will be apparent from the following description and drawings.

BRIEF DESCRIPTION OF THE DRAWINGS

FIG. 1 is a perspective view of one embodiment of the invention, partly broken away.

FIG. 2 is a longitudinal vertical sectional view of the embodiment of FIG. 1, showing lock tumblers arranged at floating alignment by a correctly bitted key.

FIG. 3 is an enlarged isolated perspective view of a split-pin lock tumbler used in the embodiment of FIGS. 1 and 2.

FIG. 4 is a developed reduced schematic view of the array of lock tumblers of FIGS. 1–3, shown in the position of constant misalignment.

FIG. 5 is a cross sectional view taken on line 5—5 of FIG. 1, with couple and travel clearances exaggerated.

FIG. 6 is a longitudinal vertical sectional view of a second embodiment of the invention, showing the tumblers arranged at fixed alignment by a correctly bitted lock key.

FIG. 7 is an enlarged isolated perspective view of a split-pin lock tumbler used in the embodiment of FIG. 6.

FIG. 8 is a developed reduced schematic view of the array of lock tumblers of FIGS. 6–7, shown in the position of constant misalignment.

FIG. 9 is a cross sectional view, partly broken away, taken on line 9—9 of FIG. 6.

FIG. 10 is a cross sectional view of a third embodiment of the invention.

FIG. 11 is a schematic view of a known single-tumbler-in-single-chamber arrangement.

DESCRIPTION OF THE PREFERRED EMBODIMENTS

FIGS. 1–5 illustrate lock 10, which has splined plug 34 retained axially rotatable within main bore 12 of splined cylinder 11. Collar portion 38 of plug 34 is seated within counterbore 14 of cylinder 11, and tail piece 39 is fastened to plug 34 by set screw 40 to close rear assembly opening 15 of cylinder 11. Shaft guide wall portion 36 of plug 34 is radially spaced from bore guide wall portion 16 of cylinder 11 to circumferentially define a single, radially uniform tumbler chamber 13. Eight split-pin tumblers 20 are located together adjacent within chamber 13, and travel axially therein from a constant misalignment arrangement at position A through a plurality of variable misalignment arrangements to an alignment arrangement at position B. All tumblers 20 have the same overall length, but each has a variable length plug pin 22 and a complementary length cylinder pin 24. A chamfered alignment plane 21 is formed at the abutment of each pair of plug and cylinder pin components. Inwardly radial ribs 23 of plug pins 22 follow axial splines 37 of plug 34 and are engaged therewith. Outwardly radial ribs 25 of cylinder pins 24 follow axial splines 17 of cylinder 11 and are engaged therewith. Whenever tumblers 20 are misaligned, alignment planes 21 are non-coplanar, plug pins 22 mesh with cylinder pins 24 (FIG. 4), plug 34 is coupled to cylinder 11, and lock 10 cannot be operated. While tumblers 20 are aligned, alignment planes 21 are coplanar, plug pins 22 do not mesh with cylinder pins 24, plug 34 is uncoupled from cylinder 11, and lock 10 can be operated.

Equal length lead pins 44 slide within axial keyway bores 42, which intersect chamber 13 through plug collar 38. Varying length tumbler aligning bits 48 of a correct key 47 enter keyway bores 42, push lead pins 44, and mechanically cause tumblers 20 to variably travel to alignment B, at which position key 47, mated with plug 34 through keyway 42, can turn plug 34 relative to cylinder 11.

Friction caused by the tumblers 20 bearing upon the guide walls 16 and 36 acts to drag the tumblers so that they do not overtravel alignment due to momentum imparted by the key. A subset of the dragged tumblers 20, including the lower tumbler in FIG. 2, travels to alignment B contacted with a single axial compression spring 27, as another subset of tumblers 20, including the upper tumbler in FIG. 2, travels to alignment B spaced from spring 27. Whenever key 47 is removed from keyway 42, tumbler returning spring 27 overcomes all drag resistances and returns each and every tumbler 20 from all alignment and variable misalignment arrangements back to the constant misalignment arrangement at A, whereat burrs 45 of lead pins 44 are retained by collar 38 within chamber 13, thereby preventing further tumbler travel.

The dragging produced by friction can be increased or substituted for, to meet the requirements of various specialized locking applications, by such things as powders, lubricants, springs, or magnets.

FIGS. 6–9 illustrate a lock 50 that is similar in overall construction to lock 10 in FIGS. 1–5, but has seven split-pin tumblers 60 that are non-ribbed. Tumblers 60 are together adjacent within the same chamber 53 and travel therein to an alignment arrangement at position D. Plug 81, retained clockwise rotatable (indicated by arrow E) with respect to cylinder 51, has a fixed shear block portion 82 that abuts a fixed shear block portion 56 of cylinder 51. A single lead tumbler 60*a* (FIG. 8) of tumblers 60 is adjacent to a shearing wall 57 of cylinder shear block 56. A single trailing tumbler 60*b* of tumblers 60 is adjacent to a shearing wall 83 of plug shear block 82. Whenever tumblers 60 are misaligned, alignment planes 61 of tumblers 60 are non-coplanar, tumbler plug pins 62 mesh with cylinder pins 64, plug 81 is circumferentially coupled to cylinder 51 by tumblers 60 that engage shearing walls 57 and 83, and lock 50 cannot be operated. While tumblers 60 are aligned, alignment planes 61 are coplanar, plug pins 62 do not mesh with cylinder pins 64, plug 81 is uncoupled from cylinder 51, and lock 50 can be operated.

Bits 88 or key 87 enter keyway bores 85, push varying length lead pins 86, align tumblers 60, and operate lock 50. Seven helical springs 74 are each located partially within chamber 53 and partially within one of a plurality of parallel chamber recesses 54 that are spaced apart to prevent adjacent spring 74 from becoming entangled.

FIG. 10 illustrates a lock 90 that is also similar in overall construction to lock 10 in FIGS. 1–5, but has seven non-ribbed split-pin tumblers 97 combined with a single ribbed split-pin tumbler 98 to couple a plug 101 to a cylinder 91 whenever misaligned. Tumblers 97 and 98 are together adjacent within the same chamber 92, and are caused to axially travel therein to an alignment arrangement by a correct key (not shown) that operates lock 90.

A single axial compression spring (not shown) is also used to collectively return all tumblers 97 and 98 to a constant misalignment arrangement. Tumbler drag is herein assisted by a radial compression ring 95, retained in an annular groove 96 of cylinder 91. Ring 95 biases every tumbler 97 and 98, and prevents the same from falling through alignment when lock 90 is oriented vertically face up.

In the lock of FIGS. 1–5, and in the lock of FIG. 10, without the correct key, long traveling tumblers cannot be readily distinguished from short traveling tumblers. If, during any attempt to manipulate the tumblers, a spaced tumbler is probed beyond alignment, a temporary manipulative lockout occurs since that tumbler cannot be returned independent of the other tumblers. Reverse picking of spaced tumblers is therefore rendered virtually impossible. Also, alignment of the tumblers is at an indefinite coplanar location that may infinitely vary within a bounded space of the chamber (hereinafter referred to as "floating alignment"), rather than at a location that is fixed (as in the lock of FIGS. 6–9). Without the knowledge of an exact alignment location, manipulation is made more difficult, being further confounded by an infinite number of variable false floating alignment planes that form wheresoever adjacent tumblers become aligned together but remain misaligned with other tumblers. Direct picking of the tumblers is therefore rendered statistically improbable.

FIG. 11 schematically illustrates a split-pin tumbler 120, such as that shown in Heyer U.S. Pat. No. 1,498,035, under torque to demonstrate for comparison purposes the way in which couple and travel clearances relative to manipulated alignment of the tumblers are developed (being herein called a single-to-shear coupling array). A common tumbler chamber 113 directionally offsets between a plug 131 and a cylinder 111 a small distance equal to the travel clearance uniformly present to each and every tumbler. Couple clearance 118 is developed within cylinder 111 and forms a fixed plug alignment feedback step 132 present to the cylinder pin 124 of each and every tumbler 120. Travel clearance 116 is sustained within plug 131, and forms a fixed cylinder feedback step 112 present to the plug pin 122 of each and every tumbler 120. Thus feedback information is provided at two fixed locations for every tumbler of the lock, a manifestly low security formulation. Similar manipulative feedback information is sequentially provided in the concentric tumbler array of Wise U.S. Pat. No. 1,696,829.

In the lock of FIGS. 1–5, the ribbed split-pin tumblers are arrayed such that under torque (indicated by arrow E in FIG. 5), couple clearances 32 are developed beside the respective ribs 23, 25 and splines 17, 37 of overlapping plug pins **22*a* and cylinder pins 24*a*, as travel clearances 30 are sustained between the respective ribs 23, 25 and splines 17, 37 of non-overlapping plug pins 22*b* and cylinder pins 24*b*. When probed, adjacent tumblers change from couple clearance 32 to travel clearance 30**, vice versa, and no fixed feedback steps are provided.

In the lock of FIGS. 6–9, the non-ribbed split-pin tumblers are arrayed as shown in FIG. 8 such that under torque (indicated by arrow F), FIG. 8, chamber 53 directionally offsets between plug 81 and cylinder 51 a distance equal to the sum of all tumbler travel clearances collectively present to all tumblers 60. Couple clearance 78 forms a fixed plug alignment feedback step 84 present to the cylinder pin **64*b* of trailing tumbler 60*b* only. Travel clearance 76 forms a fixed cylinder alignment feedback step 58 present to the plug pin 62*a* of leading tumbler 60*a* only. No clearances, couple 78 or travel 76, are present to the cylinder pins 64*c* of intermediate tumblers 60*c*, no clearances are present to the trapped plug pins 62*c* of intermediate tumblers 60*c*, and travel clearance 76 is present to the untrapped plug pins 62*d* of intermediate tumblers 60*c*. Thus, two and only two fixed feedback steps are provided for all the tumblers of the lock, which steps are effectively concealed by tapered shear walls 77 of tumbler 60*a*, and by interlocking shear walls 79 of tumblers 60*c***.

In the lock of FIG. 10 non-ribbed split-pin tumblers 97 and ribbed tumbler 98 develop couple and travel clearances in a complex coupling array that combines features of the arrays shown in both FIGS. 1–5 and in FIGS. 6–9.

Variations of outwardly radial and inwardly radial split-pin tumblers, as well as combinations that include ribbed pins, non-ribbed pins, and fixed shear blocks, provide other practical embodiments.

Practical embodiments of collectively dragged and collectively returned lock tumblers for electronically operated locks are also realizable.

Further embodiments will be apparent to those skilled in this art.

What is claimed is:

1. A lock comprising:

a cylinder, means for forming a tumbler chamber within said cylinder, means for forming a keyway that intersects said chamber, a plurality of lock tumblers located together within the same said chamber, said tumblers traveling therein from a constant misalignment arrangement through a plurality of variable misalignment arrangements to an alignment arrangement, wherein whenever said tumblers are misaligned the said lock cannot be operated and while said tumblers are aligned the said lock can be operated, a key having a plurality of bits that can enter said keyway to contact said tumblers, and cause the same to variably travel toward said alignment arrangement, means for dragging said travel of every said tumbler, wherein whenever said key causes said tumblers to travel toward said alignment arrangement said means for dragging is sufficient to prevent said tumblers from traveling beyond said alignment arrangement, and means for collectively returning said tumblers from all said alignment and variable misalignment arrangements back to said constant misalignment arrangement whenever said key is removed from said keyway, wherein whenever said key causes said tumblers to travel toward said alignment arrangement one or more of said dragged tumblers travels to said alignment arrangement contacted with said means for returning and the remaining dragged tumbler or tumblers travels to said alignment arrangement spaced from said means for returning, in said constant misalignment arrangement said means for returning is in contact with all of said tumblers, and in any alignment or misalignment arrangement no tumbler is positioned between said means for returning and any other tumbler, said means for collectively returning comprising a coil spring.

2. The lock of claim 1 wherein said bits of said key remain in contact with said tumblers throughout said operation of said lock.

3. The lock of claim 2 wherein said tumblers are together adjacent within said chamber.

4. The lock of claim 3 further comprising a plug, wherein said cylinder and said plug together define said tumbler chamber, each of said tumblers is a split-pin tumbler comprising a plug pin and a cylinder pin, said spring being in contact with all of said cylinder pins in said constant misalignment arrangement and being spaced from a subset of said cylinder pins while said cylinder pins travel to said alignment arrangement and when said cylinder pins are in said alignment arrangement, said tumblers couple said plug to said cylinder whenever misaligned, and said plug is uncoupled from and movable with respect to said cylinder while said tumblers are aligned.

5. A lock comprising:

a cylinder having a spline, a plug having a spline, said plug coupled with said cylinder when said lock is locked, one of said plug and said cylinder being movable with respect to the other when said plug is uncoupled from said cylinder, and said plug and cylinder together defining a tumbler chamber, and a plurality of split-pin lock tumblers located together adjacent within the same said chamber, said tumblers traveling therein from a constant misalignment arrangement through a plurality of variable misalignment arrangements to an alignment arrangement, and said tumblers having a plurality of ribs, at least one of which engages said cylinder spline and at least another of which engages said plug spline, wherein said tumblers couple said plug to said cylinder through said ribs whenever misaligned and while said tumblers are aligned said plug is uncoupled from said cylinder.

6. The lock of claim 5 wherein said plug is rotatable with respect to said cylinder when said plug is uncoupled from said cylinder.

7. The lock of claim 6 wherein said tumblers are together circumferentially adjacent.

8. The lock of claim 5 wherein said cylinder and said plug each have a plurality of splines.

9. A lock comprising:

a cylinder, a plug, said plug being coupled with said cylinder when said lock is locked, one of said plug and said cylinder being movable with respect to the other when said plug is uncoupled from said cylinder, and said cylinder and said plug together defining a tumbler chamber, means for forming a keyway that intersects said chamber, means for coupling said plug to said cylinder when said lock is locked.

a plurality of split-pin tumblers that are located together adjacent within the same said chamber, said tumblers traveling therein from a constant misalignment arrangement through a plurality of variable misalignment arrangements to an alignment arrangement, wherein said tumblers couple said plug to said cylinder through said means for coupling whenever misaligned, while said tumblers are aligned said plug is uncoupled from said cylinder, and whenever said tumblers are misaligned and said plug is torqued relative to said cylinder, said tumblers directly engage each other and collectively engage said means for coupling to prevent movement of said plug relative to said cylinder, a key having a plurality of bits that can enter said keyway and cause said tumblers to variably travel to said alignment arrangement whereat said key can cause relative movement between said plug and said cylinder and thereby operate said lock, and a single spring for collectively returning said tumblers from all said alignment and variable misalignment arrangements back to said constant misalignment arrangement whenever said key is removed from said keyway.

10. The lock of claim 9 wherein said means for coupling comprises a fixed shear block portion of said cylinder projecting into said tumbler chamber from the surface of said cylinder that faces said plug and a fixed shear block portion of said plug projecting into said tumbler chamber from the surface of said plug that faces said cylinder.

11. The lock of claim 10 wherein at least two adjacent tumblers have corresponding indentations and projections in their walls along the interface between said tumblers, whereby the indentations of one of the tumblers interlock with the projections of the other of said tumblers under torque applied to said plug relative to said cylinder when one of said tumblers is moved longitudinally with respect to the other.

12. The lock of claim 10 wherein each said tumbler comprises a plug pin and a cylinder pin, said fixed cylinder shear block portion has a wall that touches one said cylinder pin along a wall thereof when said plug is torqued in one direction relative to said cylinder, said cylinder pin has a corresponding plug pin that abuts said cylinder pin at an interface therebetween and that has a wall corresponding to the wall of said cylinder pin that touches said fixed cylinder shear block, and said cylinder pin and corresponding plug pin are tapered inwardly toward said interface and away from said cylinder shear block wall along their said walls.

13. The lock of claim 9 wherein said key can couple with said plug and move the same relative to said cylinder.

14. The lock of claim 9 wherein said keyway has a plurality of bores that intersect said chamber, said travel of said tumblers is axial with respect to said keyway bores, and further comprising a plurality of lead pins each of which slides axially within one of said keyway bores.

15. The lock of claim 9 wherein said split-pin tumblers are together circumferentially adjacent, said plug has an axis about which it is rotatable with respect to said cylinder when uncoupled therefrom, said tumbler chamber is of constant axial cross section, said keyway has an axis parallel with the axis of said plug, and said tumblers travel in said tumbler chamber in a direction parallel with the axis of said plug.

16. The lock of claim 9 wherein each said tumbler comprises a plug pin and a cylinder pin and said means for coupling comprises a spline in said cylinder, a spline in said plug, and at least one of said tumblers having on its plug pin a rib that engages the spline in said plug and having on its cylinder pin a rib that engages the spline in said cylinder, wherein said tumblers couple said plug to said cylinder through said ribs and splines whenever said tumblers are misaligned and when said tumblers are aligned said plug is uncoupled from said cylinder.

17. A lock comprising:

a cylinder, a single tumbler chamber within said cylinder, said cylinder having an inner surface bounding said tumbler chamber and having a plurality of spaced apart recesses in said inner surface, said recesses having axes that are parallel to each other.

means for forming a keyway that intersects said chamber, a plurality of lock tumblers that are located together adjacent within the same said chamber, said tumblers traveling therein parallel to said recesses from a constant misalignment arrangement through a plurality of variable misalignment arrangements to an alignment arrangement, wherein whenever said tumblers are misaligned the said lock cannot be operated and while said tumblers are aligned the said lock can be operated, and means for returning said tumblers from all said alignment and variable misalignment arrangements back to said constant misalignment arrangement comprising a plurality of biased members each located partially within the same said tumbler chamber and partially within one of said recesses, said biased members having axes that are parallel with the direction of said returning and are parallel to the axes of said recesses, and said recesses being at least as long as said biased members along said axes in the direction of said returning, and a plug positioned within said cylinder and having an outer surface bounding said tumbler chamber, said tumblers directly engaging each other whenever said tumblers are misaligned and said plug is torqued relative to said cylinder.

18. The lock of claim 17 wherein said travel of said tumblers is axial with respect to said keyway.

19. The lock of claim 17 wherein said tumblers couple said plug to said cylinder whenever misaligned, and said plug is uncoupled from and movable with respect to said cylinder while said tumblers are aligned.

20. The lock of claim 19 wherein each said tumbler is a split-pin.

* * * * *